United States Patent [19]

Frisbee

[11] 4,405,019

[45] Sep. 20, 1983

[54] ADJUSTMENT AND STABILIZER MECHANISM FOR DOZER BLADE

[75] Inventor: Claude M. Frisbee, Bettendorf, Iowa

[73] Assignee: J. I. Case Company, Racine, Wis.

[21] Appl. No.: 299,358

[22] Filed: Sep. 4, 1981

[51] Int. Cl.[3] ..... E02F 3/76

[52] U.S. Cl. ..... 172/816; 172/821; 172/826; 172/827

[58] Field of Search ..... 172/826, 816, 821, 820, 172/822, 830, 831, 827

[56] References Cited

U.S. PATENT DOCUMENTS

| | | | |
|---|---|---|---|
| 1,923,412 | 8/1933 | Bacon | 172/830 |
| 1,974,520 | 9/1934 | Stewart | 172/816 |
| 1,977,817 | 10/1934 | Bird | 172/816 |
| 3,158,944 | 12/1964 | Rehberg | 172/826 |
| 3,661,215 | 5/1972 | Pensa | 172/826 X |
| 3,773,116 | 11/1973 | Coontz | 172/822 |
| 4,076,080 | 2/1978 | Anderson | 172/821 |
| 4,133,392 | 1/1979 | Freese | 172/816 |
| 4,244,429 | 1/1981 | Nissen | 172/821 |

FOREIGN PATENT DOCUMENTS

| | | | |
|---|---|---|---|
| 2710320 | 9/1978 | Fed. Rep. of Germany | 172/821 |

*Primary Examiner*—Richard J. Johnson
*Attorney, Agent, or Firm*—Cullen, Sloman, Cantor, Grauer, Scott & Rutherford

[57] ABSTRACT

A mechanism for angling, pitching, and tilting a dozer blade utilized in a conventional bulldozer wherein the blade is pivotally connected by an angling frame to the forward ends of push arms. A tilt-pitch control assembly for the blade is provided including a pitch cylinder, a pitch-tilt cylinder, a torsion bar, and drag link connections. The pitch cylinder and pitch-tilt cylinder are each pivotally attached to the torsion bar by the drag link connections. If a load is applied against one side of the blade, the load is transmitted to the pitch cylinder or pitch-tilt cylinder closest to the loaded side of the blade thereby causing some movement of that cylinder. The cylinder which is under load transmits any movement through its respective drag link connection into a turning movement on the torsion bar. This turning movement on the torsion bar is, in turn, transmitted to the opposite side of the blade and to the unloaded cylinder which provides support to the loaded cylinder for counteracting any uneven or undistributed loads on the blade. The pitch-tilt cylinder includes opposed extensible piston rods for providing maximum blade tilt at all pitch positions of the blade. This overcomes the problem of having no tilt cylinder stroke available to tilt the blade when the blade is fully pitched forwardly or rearwardly. Thus, the present construction provides for maximum blade tilt at all pitch positions of the blade and a stabilizing arrangement to prevent the blade from following the path of least resistance when uneven loads are applied to the blade.

5 Claims, 8 Drawing Figures

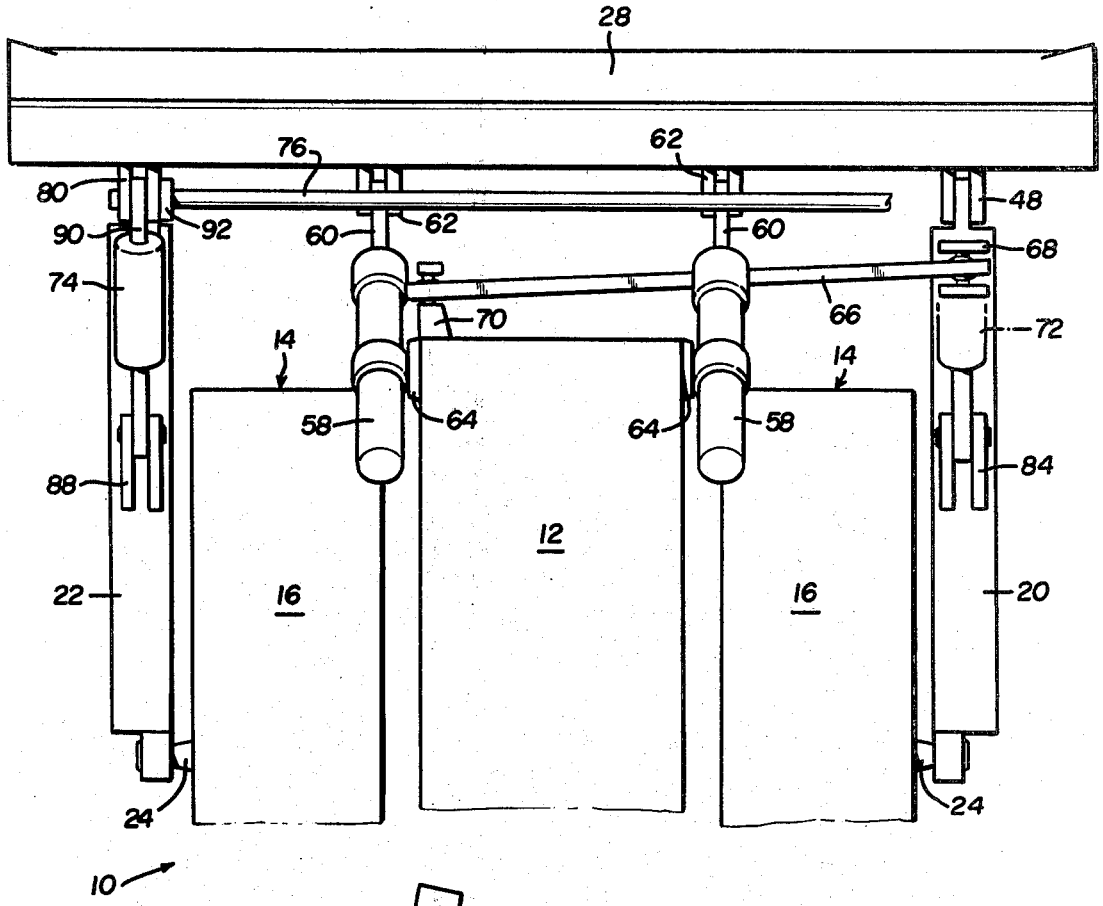
FIG. 4
FIG. 3
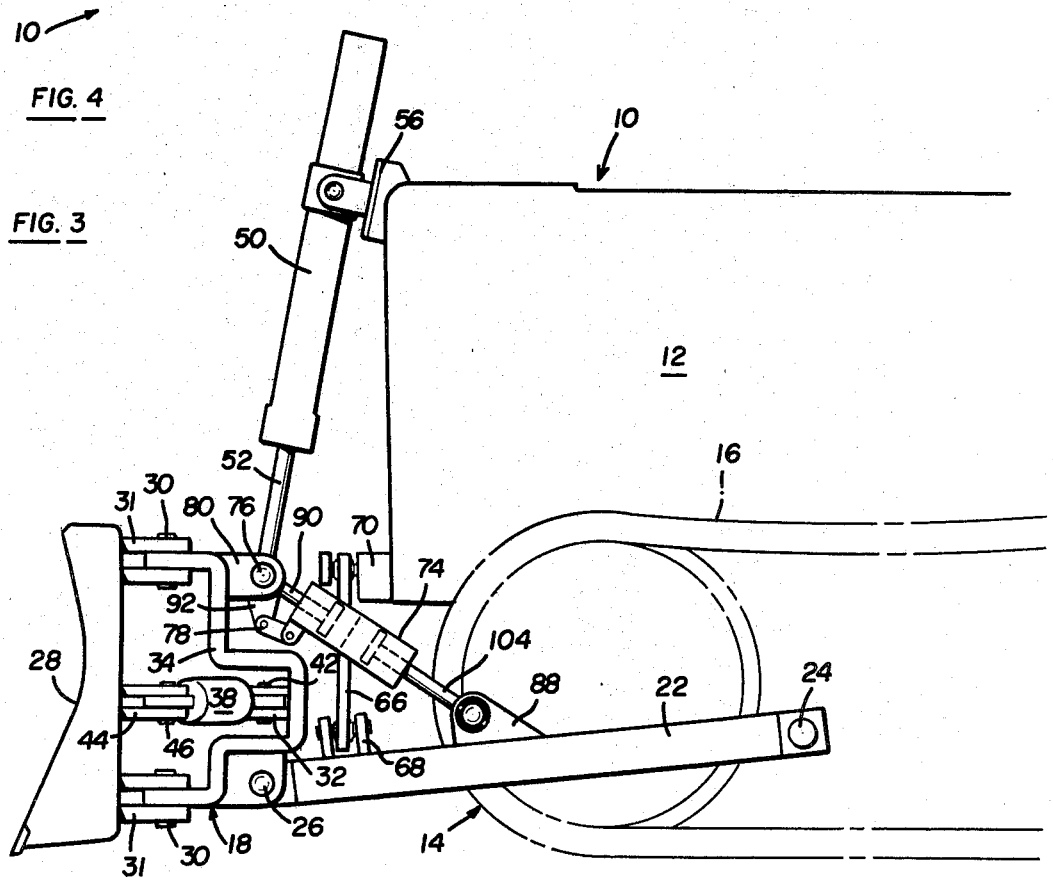

ADJUSTMENT AND STABILIZER MECHANISM FOR DOZER BLADE

BACKGROUND OF THE INVENTION

The present invention relates to bulldozers or the like having transversely extending material moving blades, and more particularly, to an improved and simplified mechanism for angling, tilting, and pitching the material moving blade.

In non-angling types of known bulldozer blade arrangements, tilting of the blade has been accomplished conventionally by pivotally connecting the back of the blade to the forward end of the push arms of a C-shaped frame and providing extensible piston cylinders between the push arms and the top of the blade. Tilting of the blade in this known construction is accomplished by retracting the piston cylinder on one push arm and at the same time extending the piston cylinder on the other push arm.

In known angling types of bulldozer blades, the load handling blade is mounted on the earth moving equipment by means of a central swivel joint, one part of which is attached to the rear of the blade and the companion part is attached to the pusher frame of the earth moving equipment so as to permit pitch movement, pivotal side or angular movement, and edgewise tilting movement of the blade. Various problems occur in the design of such mechanism, particularly when in addition to the angling provision of the blade, tilting of the blade about a longitudinal axis is desired.

One type of prior art construction provides a pair of fluid cylinders attached to the rear of the blade at one end thereof and having their other end attached to the frame of the earth moving equipment, which, when selectively actuated, vary the angle of the blade by pivoting the blade around a vertical axis of the swivel joint relative to the longitudinal axis of the machine. Normally, to vary the vertical position of the blade edgewise for tilting, a separate fluid motor has been provided in addition to the fluid motors for angling of the blade.

With this prior arrangement, when the tilting motor is actuated to accomplish vertical tilt adjustment of the blade, the pair of angling motors are urged to move arcuately in opposite vertical directions. A problem with the prior art mounting arrangement is that the arrangement is subjected to excessive stresses, and the amount of tilt adjustment of the blade is restricted. It is wellknown that earth moving machines of this character are subject to considerable shock loads during operation and therefore must be of extremely rugged construction.

Another problem associated with these prior art blade control arrangements is that they have no tilt cylinder stroke available to tilt the blade when the blade is fully pitched forwardly or rearwardly. Thus, maximum tilt for the blade can only take place when the blade is in its mid-pitch position. In bulldozers, complete adjustability of the dozer blade renders the machine more versatile. Therefore, there has been a need for a simplified mechanical construction that permits complete adjustability of the blade.

A further problem with prior constructions occurs when an uneven load is applied to the blade during pitching or angling. If one side of the blade is under a load while the other side is not, the blade will follow the path of least resistance which may tilt the blade when pitching is desired. When the blade is set at a desired position such as for forming a ditch or leveling a road, the blade must be capable of maintaining the position selected.

These disadvantages of present bulldozer constructions have resulted in the adjustment and stabilizer construction for dozer blades of the present invention which effectively eliminates the above difficulties of the prior art.

SUMMARY OF THE INVENTION

In accordance with the present invention, an adjustment and stabilizer mechanism for dozer blades is disclosed which permits angling, tilting, and pitching of the blade. The blade control mechanism provides for maximum blade tilt at all pitch positions of the blade thereby rendering the construction more versatile than prior arrangements. Further, a stabilizer mechanism is provided to prevent the blade from following the path of least resistance when uneven loads are applied to the blade.

The blade adjustment and stabilizer construction of the present invention may be utilized in a conventional bulldozer having opposite parallel push arms extending longitudinally along drive track frames. In a first embodiment, a blade angling frame is pivotally attached to the forward ends of the push arms and a conventional dozer blade is pivotally mounted on the front of the angling frame so as to permit angling movement of the blade. The angling control includes a pair of piston cylinders connected at one end to the angling frame and their opposed ends connected to the respective sides of the bulldozer blade. The angle cylinders are hydraulically placed in series for enabling one of the angle cylinders to be extended while the other is retracted to angle the blade about a vertical axis.

A tilt-pitch control assembly for the blade is provided including a pitch piston cylinder, a pitch-tilt piston cylinder, a torsion bar, and drag link connections. The pitch cylinder and pitch-tilt cylinder are each pivotally attached to the torsion bar by the drag link connections. When the pitch and pitch-tilt cylinders are extended or retracted for pitching the blade, the torsion bar and drag link connections force the cylinders to move in unison.

If a load is applied against one side of the blade and not against the other side, the load is transmitted to the piston cylinder closest to the loaded side of the blade, thereby causing some movement of that piston cylinder. The piston cylinder which is under load transmits any movement through its respective drag link connection into a twisting or turning movement on the torsion bar. This twisting movement on the torsion bar is, in turn, transmitted to the opposite side of the blade and to the unloaded piston cylinder. The unloaded piston cylinder then provides support to the loaded piston cylinder through the torsion bar for counteracting any uneven or undistributed loads on the blade. Thus, a stabilizing construction is provided for the blade to prevent the blade from following the path of least resistance when uneven loads are applied to the blade.

The pitch-tilt cylinder includes opposed extensible piston rods to permit both pitching and tilting operations and for providing maximum blade tilt for all pitch positions of the blade. A pitch control valve is adjusted to supply fluid pressure into the pitch cylinder and pitch-tilt cylinder for pitching the blade forwardly and rearwardly. Blade tilt is possible at any pitch position of the blade by actuating a tilt control valve that supplies fluid pressure to the pitch-tilt cylinder for extending it and thereby tilting the blade. Thus, the pitch-tilt cylinder provides a maximum amount of blade tilt for all pitch positions of the blade. This overcomes the known problem of having no tilt cylinder stroke available to tilt the blade when the blade is fully pitched forwardly or rearwardly.

Other advantages and meritorious features of the adjustment and stabilizer construction for dozer blades of the present invention will be more fully understood from the following description of the invention, the appended claims, and the drawings, a brief description of which follows.

BRIEF DESCRIPTION OF DRAWINGS

FIG. 3 is a side elevational view of an earth-working machine embodying the invention and illustrating a more compact arrangement where the blade is moved closer to the tractor frame.

FIG. 4 is a top plan view of an earth-working machine including an embodiment of the adjustment and stabilizer construction which permits pitching and tilting of the blade, but no angling of the blade.

DETAILED DESCRIPTION OF THE INVENTION

Figure 1:
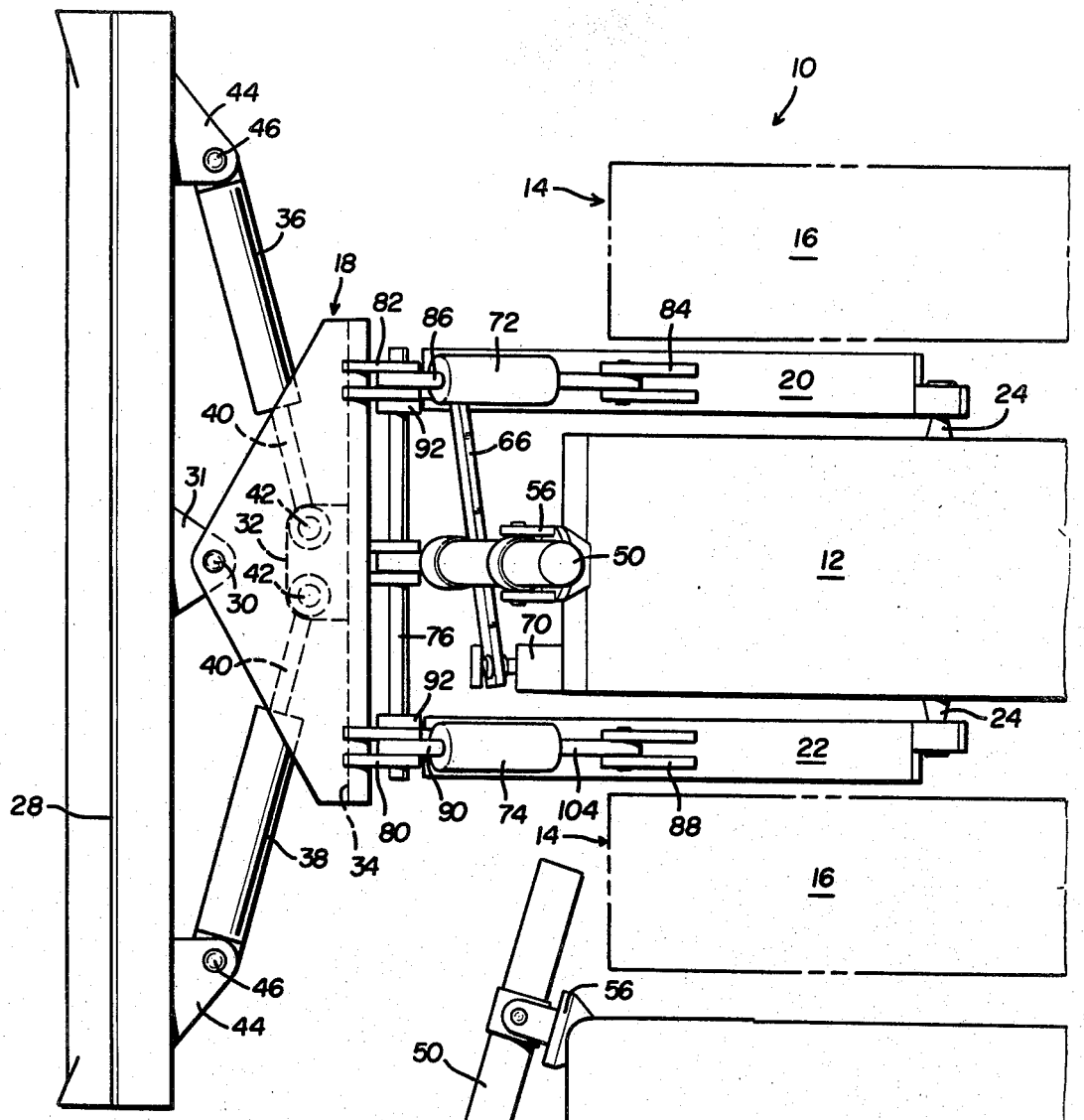
FIG. 1 is a top plan view of an earth-working machine including the adjustment and stabilizer construction for dozer blades made in accordance with the present invention.
Figure 2:
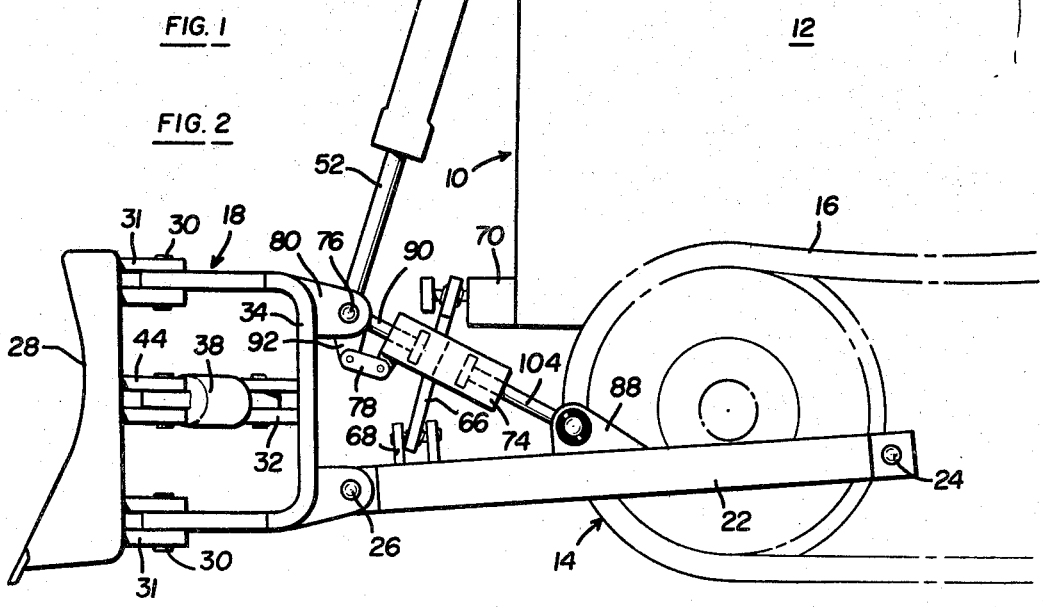
FIG. 2 is a side elevational view of the earth-working machine illustrated in FIG. 1.

The earth-working machine including an adjustment and stabilizer construction for dozer blades made in accordance with the teachings of the present invention is illustrated in FIGS. 1–8. FIGS. 1–2 illustrate a first embodiment of the adjustment and stabilizer construction which permits pitching, tilting, and angling of the blade. FIG. 3 illustrates a more compact arrangement of the adjustment and stabilizer construction shown in FIGS. 1–2 where the blade is moved closer to the tractor frame. FIG. 4 illustrates a second embodiment of the adjustment and stabilizer construction which permits pitching and tilting of the blade, but no angling of the blade.

The tractor 10 is seen to include a main frame 12 flanked by a pair of drive track frames 14. As is well-known, track roller assemblies (not shown) may be provided on each of the track frames 14 for engaging track chains 16. As illustrated in FIGS. 1–3, tractor 10 carries a blade angling frame 18 at the forward end thereof which is substantially C-shaped in vertical cross-section. The free ends of opposite parallel push arms 20 and 22 extend longitudinally along inner sides of the drive track frames 14 and are independently pivotally connected to opposite sides of frame 12 by universal joints 24. The non-angling embodiment of the present invention illustrated in FIG. 4 does not include blade angling frame 18, however, it does include laterally spaced apart push arms 20 and 22 flanking the outer sides of track frames 14 with the push arms being independently pivoted to track frames 14 by universal joints 24.

Again referring to FIGS. 1–3, blade angling frame 18 is pivotally attached at its lower end to the forward ends of push arms 20 and 22 by means of pivot connections 26 thereby permitting pivotal movement of frame 18 about a transverse horizontal axis. A conventional transverse dozer blade 28 is pivotally mounted on the front end of frame 18, substantially at its midpoint, by upper and lower vertical pins 30 connected to mounting lugs 31 on the back of blade 28 so as to permit angling movement of the blade. A mounting lug 32 is secured on leg 34 of frame 18 approximately midway of its vertical extent for securing one end of angle cylinders 36 and 38. The piston rod 40 of each angle cylinder 36 and 38 is pivotally connected by vertical pin 42 to the mounting lug 32 on frame 18 and the opposite end of each angle cylinder is pivotally mounted to lugs 44 on the back of blade 28 by vertical pin 46.

The angle cylinders 36 and 38 are hydraulically placed in series for enabling one of the angle cylinders to be extended while the other is retracted, all for the purpose of selectively adjusting the angle of dozer blade 28 relative to the vertical axis defined by pivot pins 30. Further, pivot connections 26 permit pivotal movement of frame 18 and blade 28 about a transverse horizontal axis for forward and rearward pitching of blade 28.

Referring to FIGS. 2 and 3, frame 18 may be configured for permitting blade 28 to be positioned closer to tractor 10 if desired. The angle frame leg 34 shown in FIG. 2 is made substantially vertical for easier fabrication when compactness is not required. Alternatively, frame leg 34 may be bent to bring blade 28 closer to tractor 10 as shown in FIG. 3 thereby providing a more compact arrangement. The operation of the tilt, pitch, or angle functions for blade 28 are not affected by changing the configuration of frame leg 34 from the configuration shown in FIG. 2 to the configuration shown in FIG. 3.

The non-angling embodiment of the present invention shown in FIG. 4 does not include blade angling frame 18 or angle cylinders 36 and 38. Instead, blade 28 is secured to the forward ends of push arms 20 and 22 by means of a pair of clevis-type connections 48 located near the lower end of blade 28 and on the backside thereof. Connections 48 provide for pivotal mounting of blade 28 on push arms 20 and 22 for movement about a transverse horizontal axis.

As illustrated in FIGS. 1–3, blade 28 is raised and lowered by a conventional hydraulic actuator 50 supported on the front end of main frame 12 and having a piston rod 52 pivotally connected on the back of frame 18 at lugs 54 (FIG. 1). Hydraulic lift cylinder 50 is suitably secured within a trunnion mounting 56 mounted to frame 12 such that it has complete freedom of movement in any direction. For the non-angling construction shown in FIG. 4, blade 28 is raised and lowered by conventional hydraulic actuators or lift cylinders 58 supported on opposite sides of frame 12 and having piston rods 60 pivotally connected by means of clevis-type connections 62 to the backside of blade 28. The hydraulic lift cylinders 58 are suitably secured within trunnion mountings 64 mounted to the side walls of frame 12 such that they have complete freedom of movement in any direction.

The present invention utilizes a bracing or stabilizer link 66 interconnected between tractor 10 and one of the push arms 20 or 22. Bracing link 66 is entirely located between the forward end of the tractor and blade 28 and extends transversely of tractor 10 in substantially parallel relationship with the blade. One end of link 66 is pivotally connected by a ball and socket joint to a bracket 68 on one push arm and the opposite end of link 66 is pivotally connected by a ball and socket joint to a bracket 70 depending from main tractor frame 12. Stabilizer link 66 acts as a rigid brace between the main frame 12 and push arms 20 and 22 to prevent undesirable side or lateral movement of blade 28.

The tilt-pitch control of the present invention includes a pitch piston cylinder 72, a pitch-tilt piston cylinder 74, a torsion bar 76, and drag links 78. In the blade angling embodiment shown in FIGS. 1–3, torsion bar 76 extends through and is rotatably supported by the mounting lugs 54, 80, and 82 attached to the rear of angling frame 18. Pitch cylinder 72 is connected between mounting lugs 84 on push arm 20 and mounting lugs 82 on the backside of angling frame 18, and the extensible piston rod 86 of piston cylinder 72 is pivotally attached to one end of torsion bar 76 by a ball and socket joint. Pitch-tilt cylinder 74 is connected between mounting lugs 88 on push arm 22 and mounting lugs 80 on the backside of angling frame 18, and the piston rod 90 of piston cylinder 74 is pivotally attached to the other end of torsion bar 76 by a ball and socket joint.

In the non-angling embodiment shown in FIG. 4, which has no angling frame 18, the mounting lugs 80 and 82 are attached to the backside of blade 28 and torsion bar 76 is rotatably supported between them. The tilt-pitch control is otherwise the same for both the angling and non-angling constructions shown in FIGS. 1–3 and FIG. 4.

Figure 5:
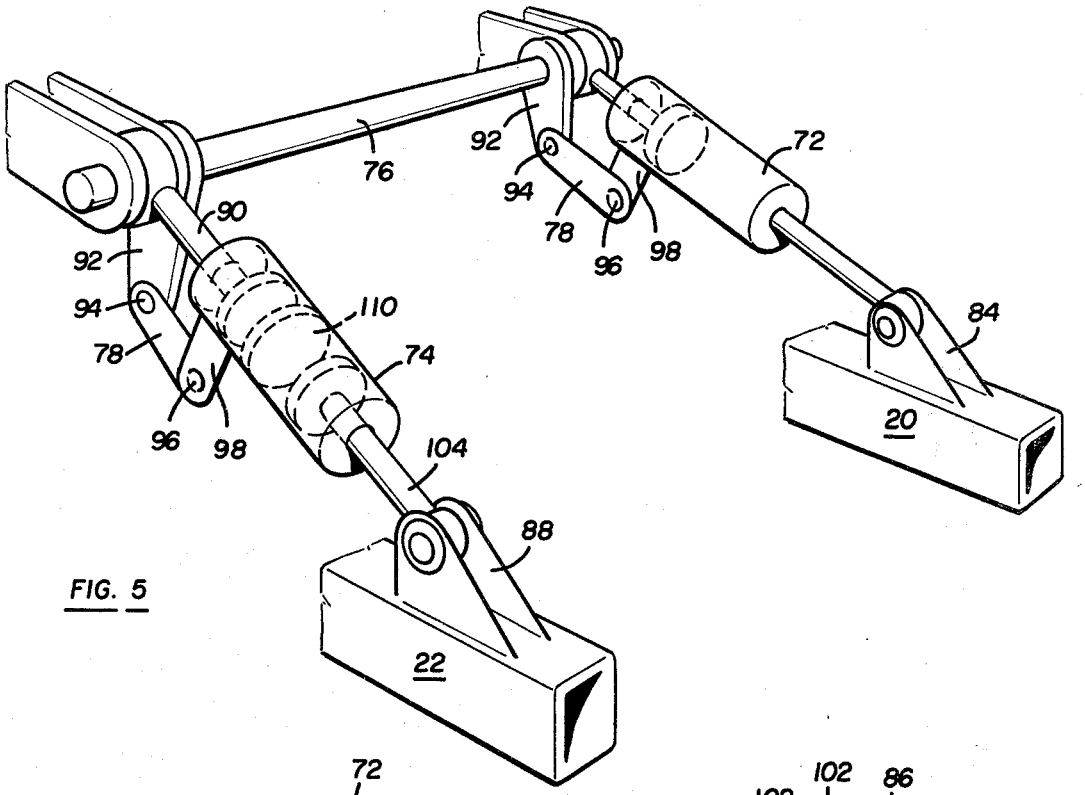
FIG. 5 is a perspective view of the tilt-pitch control assembly for the present invention.
Figure 6:
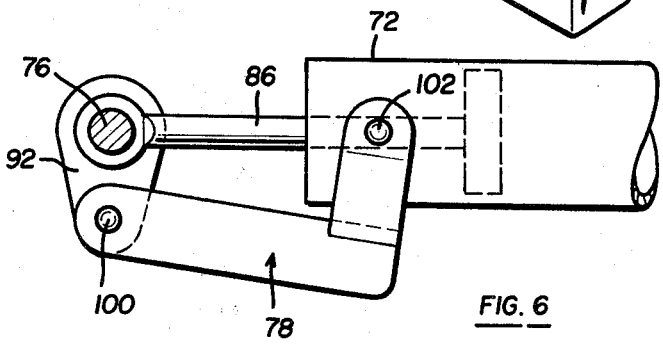
FIG. 6 is a partial side elevational view illustrating a modified form of the drag link connection for the torsion bar.
Figure 7:
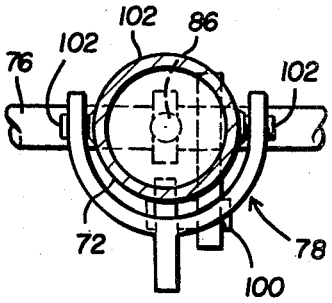
FIG. 7 is an end view of the modified drag link connection shown in FIG. 6.

Referring in particular to FIG. 5, pitch cylinder 72 and pitch-tilt cylinder 74 are each pivotally attached to torsion bar 76 by drag link connections including links 78 and torsion bar brackets 92. Bracket 92 is fixed to torsion bar 76 and includes a lower depending end that is pivotally connected to one end of link 78 by pin 94. The other end of link 78 is pivotally connected by pin 96 to a weldment 98 extending from either piston cylinder 72 or piston cylinder 74. Alternatively, drag link 78 may be formed as a yoke as shown in FIGS. 6–7 with one of its ends pivotally attached to bracket 92 by pin 100 and having its opposite bifurcated end pivotally attached on opposite sides of the respective piston cylinder by pins 102.

Figure 8:
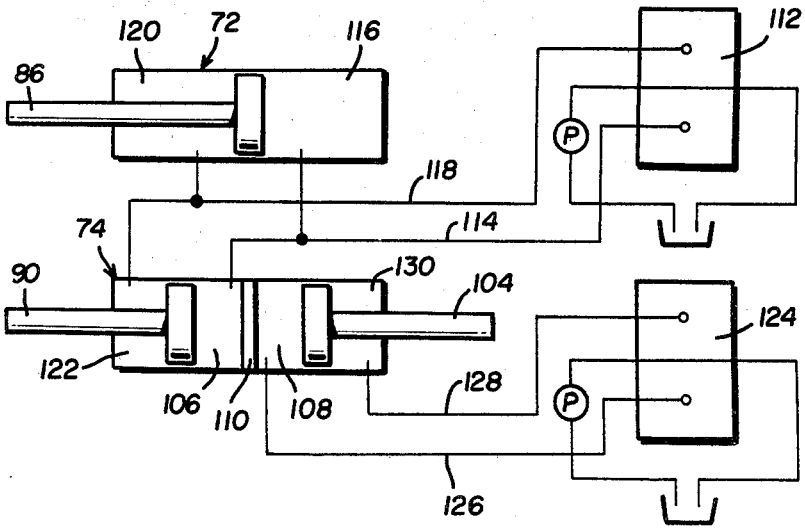
FIG. 8 is a schematic illustration of the hydraulic system for pitching and tilting the blade.

Referring to FIGS. 5 and 8, pitch-tilt cylinder 74 includes a second extensible piston rod 104 for providing maximum blade tilt for all pitch positions of blade 28. Cylinder 74 is divided into two actuating chambers 106 and 108 by interior seal 110 to permit both pitching and tilting operations. A pitch control valve 112 is adjusted to supply fluid pressure through conduit 114 into fluid chambers 106 and 116 of piston cylinders 72 and 74 for extending piston rods 86 and 90 thereby pitching blade 28 forwardly. Blade 28 is pitched rearwardly by operating valve 112 for directing fluid pressure through conduit 118 into fluid chambers 120 and 122 of piston cylinders 72 and 74 for retracting piston rods 86 and 90.

Blade tilt is possible at any pitch position of blade 28 by actuating tilt control valve 124. Valve 124 is adjusted to supply fluid pressure through conduit 126 into fluid chamber 108 of piston cylinder 74 for extending piston rod 104 and exerting an upward pull on the corner of blade 28 nearest to piston rod 104 thereby tilting the blade in one direction. Conversely, blade 28 is tilted in an opposite direction by operating valve 124 for directing fluid pressure through conduit 128 into fluid chamber 130 of piston cylinder 74 thereby retracting piston rod 104 and applying a downward push on the corner of blade 28 nearest to piston rod 104.

As described, the pitch-tilt cylinder 74 provides a maximum amount of blade tilt for all pitch positions of blade 28. This overcomes the known problem of having no tilt cylinder stroke available to tilt the blade when the blade was fully pitched forwardly or rearwardly.

Another feature of the present invention resides in the torsion bar 76 and drag link connections 78 and 92 for pitch cylinder 72 and pitch-tilt cylinder 74. When piston rods 86 and 90 of piston cylinders 72 and 74 are extended or retracted for pitching blade 28, the torsion bar 76 and drag link connections 78 and 92 force both cylinders 72 and 74 to move together regardless of other loads being applied to blade 28. If a load is applied against one side of blade 28 and not against the other side during pitching of the blade, the load is transmitted to the piston cylinder 72 or 74 closest to the loaded side of blade 28 thereby causing some movement of that piston cylinder. The piston cylinder which is under load transmits any movement through its respective drag link connection 78 and 92 into a twisting or turning movement on torsion bar 76. This twisting movement on torsion bar 76 is, in turn, transmitted to the opposite side of blade 28 and to the unloaded piston cylinder. The unloaded piston cylinder provides support to the loaded piston cylinder through torsion bar 76 for counteracting any uneven or undistributed loads on blade 28. The twisting of torsion bar 76 relaxes as soon as the uneven load on blade 28 is removed. Thus, a stabilizing construction is provided for blade 28 to prevent the blade from following the path of least resistance when uneven loads are applied to the blade.

It will be apparent to those skilled in the art that the foregoing disclosure is exemplary in nature rather than limiting, the invention being limited only by the appended claims.

I claim:

1. In an earth-working machine having a frame, a pair of push arms pivotally secured at one of their ends to said frame, and a blade pivotally secured to the push arms at their other ends, a pair of lift cylinders pivotally interconnected between said frame and said blade, the improvement comprising:

a pitch-tilt control assembly for said blade including a pitch piston cylinder, a pitch-tilt piston cylinder, a torsion bar, and a pair of drag link connections, means for mounting said torsion bar to the backside of said blade, said torsion bar extending generally parallel to the backside of said blade and being rotatable about its longitudinal axis, said pitch piston cylinder being pivotally attached at one end to said torsion bar and pivotally attached at its opposite end to one of said push arms, said pitch-tilt piston cylinder being pivotally attached at one end to said torsion bar and pivotally attached at its other end to the other of said push arms, said pitch piston cylinder and said pitch-tilt piston cylinder being additionally pivotally attached to said torsion bar by said drag link connections whereby a load on one side of said blade being transmitted to the opposite side of said blade by said torsion bar and drag link connections for counteracting uneven loads on said blade and preventing said blade from following a path of least resistance when uneven loads are applied to said blade.

2. The earth-working machine as defined in claim 1 wherein each of said drag link connections includes a bracket fixed to said torsion bar, a drag link pivotally connected at one end to a lower depending end of said bracket and having its opposite end pivotally connected to a weldment extending from a respective piston cylinder.

3. The earth-working machine as defined in claim 1 wherein each of said drag link connections includes a bracket fixed to said torsion bar, a yoke-like link pivotally connected at one end to a lower depending end of said bracket and having an opposite bifurcated end pivotally attached to opposite sides of a respective piston cylinder.

4. The earth-working machine as defined in claim 1 wherein said pitch-tilt piston cylinder includes opposed extensible piston rods mounted within a housing having an interior seal for dividing said housing into a pair of opposed actuating chambers, a pitch control valve for supplying fluid pressure into one of said actuating chambers thereby extending one of said piston rods for providing pitching movement to said blade and a tilt control valve for supplying fluid pressure into the other of said actuating chambers thereby extending the other piston rod for providing tilting movement to said blade whereby said pitch-tilt piston cylinder provides a maximum amount of blade tilt movement for all pitch positions of said blade.

5. In an earth-working machine having a frame and a pair of push arms pivotally secured at one of their ends to said frame, the improvement comprising:

a blade angling frame pivotally attached to the forward ends of said push arms and a blade pivotally mounted on the front of said angling frame for movement about a vertical axis, a pair of piston cylinders connected at one end to said angling frame and having their opposed ends connected to respective sides of said blade, one of said piston cylinders being extended while the other piston cylinder being retracted for angling said blade about said vertical axis;

a pitch-tilt control assembly for said blade including a pitch piston cylinder and a pitch-tilt piston cylinder, said pitch piston cylinder being pivotally attached at one end to said angling frame and pivotally attached at its opposite end to one of said push arms, said pitch-tilt piston cylinder being pivotally attached at one end to said angling frame and pivotally attached at its other end to the other of said push arms, and said pitch-tilt piston cylinder including opposed extensible piston rods mounted within a housing having an interior seal for dividing said housing into a pair of opposed actuating chambers, a pitch control valve for supplying fluid pressure into one of said actuating chambers thereby extending one of said piston rods for providing pitching movement to said blade, a tilt control valve for supplying fluid pressure into the other of said actuating chambers thereby extending the other of said piston rods for providing tilting movement to said blade whereby said pitch-tilt cylinder provides a maximum amount of blade tilt movement for all pitch positions of said blade; and wherein said pitch-tilt control assembly further includes a torsion bar and a pair of drag link connections, means for mounting said torsion bar to the backside of said angling frame, said torsion bar extending generally parallel to the backside of said angling frame and being rotatable about its longitudinal axis, said pitch piston cylinder and said pitch-tilt piston cylinder being pivotally attached to said torsion bar by said drag link connections whereby a load on one side of said blade being transmitted to the opposite side of said blade by said torsion bar and drag link connections for counteracting uneven loads on said blade and preventing said blade from following a path of least resistance when uneven loads are applied to said blade.

* * * * *